US006578570B2

(12) United States Patent
Fogliani et al.

(10) Patent No.: US 6,578,570 B2
(45) Date of Patent: Jun. 17, 2003

(54) METHOD OF REDUCING CO AND $NO_X$ EMISSIONS IN A HEATING APPLIANCE AND A RESPECTIVE APPLIANCE

(75) Inventors: Giuseppe Fogliani, Formigine (IT); Gunther Berthold, Modena (IT)

(73) Assignee: Worgas Bruciatori S.r.L., Formigine (IT)

( * ) Notice: Subject to any disclaimer, the term of this patent is extended or adjusted under 35 U.S.C. 154(b) by 0 days.

(21) Appl. No.: 09/462,324

(22) PCT Filed: Jun. 7, 1998

(86) PCT No.: PCT/EP98/04152

§ 371 (c)(1),
(2), (4) Date: Mar. 9, 2000

(87) PCT Pub. No.: WO99/02923

PCT Pub. Date: Jan. 21, 1999

(65) Prior Publication Data

US 2002/0056447 A1 May 16, 2002

(30) Foreign Application Priority Data

Jul. 7, 1997 (IT) ..... MO97A0124

(51) Int. Cl.[7] ..... F24C 3/00

(52) U.S. Cl. ..... 126/512; 126/92 R; 431/125

(58) Field of Search ..... 126/512, 92 R, 126/92 B; 431/125, 171, 177

(56) References Cited

U.S. PATENT DOCUMENTS

| | | | | | |
|---|---|---|---|---|---|
| 464,457 | A | * | 12/1891 | Goetz et al. | 126/92 R |
| 1,716,329 | A | * | 6/1929 | Simpson | 126/92 |
| 1,867,110 | A | * | 7/1932 | Signore | 126/92 AC |
| 1,998,427 | A | * | 4/1935 | Brown | 126/92 A |
| 3,291,116 | A | * | 12/1966 | Brooks | 126/512 |
| 3,696,801 | A | * | 10/1972 | Whitehead | 431/125 |
| 4,875,464 | A | * | 10/1989 | Shimek et al. | 126/92 R |
| 5,054,468 | A | * | 10/1991 | Moon et al. | 126/512 |
| 5,114,336 | A | * | 5/1992 | Karabin et al. | 431/125 |
| 5,191,877 | A | * | 3/1993 | Shimek et al. | 126/512 |
| 5,388,566 | A | * | 2/1995 | Smith et al. | 126/512 |
| 5,392,763 | A | * | 2/1995 | Shaw et al. | 126/512 |
| 5,452,709 | A | * | 9/1995 | Mealer | 126/512 |

(List continued on next page.)

FOREIGN PATENT DOCUMENTS

| | | | | |
|---|---|---|---|---|
| FR | 1090003 | * | 3/1955 | 126/92 R |
| GB | 258871 | * | 8/1927 | 126/92 R |
| GB | 1286323 | * | 8/1972 | 126/85 R |
| GB | 2086565 | * | 5/1982 | 26/85 R |

*Primary Examiner*—James C. Yeung
(74) *Attorney, Agent, or Firm*—Reising, Ethington, Barnes, Kisselle & Learman P.C.

(57) ABSTRACT

A method of combustion of a gaseous fuel in a heating appliance (1; 22) provided with at least one burner (15; 29; 34, 35, 36; 38), comprising mixing said gaseous fuel with a preestablished quantity of air to obtain an air-fuel mixture, supplying said mixture to the body of said at least one burner (15; 29; 34, 35, 36; 38), which is provided with a diffuser (19) on which openings (18) are made through which said mixture passes, causing the combustion of said mixture in order to generate flames (20; 32; 33; 34; 37; 42), the method further comprises irradiating heat towards said flames (20; 32; 33; 34; 37; 42) and a region directly surrounding said flames (20; 32; 33; 34; 37; 42). A heating appliance (1; 22) provided with at least one burner (15; 29; 34, 35, 36; 38) fed with a mixture of gaseous fuel and air, said at least one burner (15; 29; 34, 35, 36; 38) being provided with a diffuser (19) having openings (18) through which said mixture passes and with means (21) to cause the combustion of said mixture and the formation of flames (20; 32; 33; 34; 37; 42), the heating appliance further comprises heat irradiating means (47; 45, 46) which are capable of irradiating heat towards said flames (20; 32; 33; 34; 37; 42) and a region directly surrounding said flames (20; 32; 33; 34; 37; 42).

54 Claims, 3 Drawing Sheets

U.S. PATENT DOCUMENTS 5,660,162 A * 8/1997 Eavenson et al. ..... 126/512
5,678,534 A * 10/1997 Fleming ..... 126/512
5,816,237 A * 10/1998 Fleming ..... 126/512
5,826,569 A * 10/1998 Voorhis ..... 431/177
5,901,701 A * 5/1999 Wade ..... 126/512
5,906,197 A * 5/1999 French et al. ..... 126/512

* cited by examiner

METHOD OF REDUCING CO AND $NO_X$ EMISSIONS IN A HEATING APPLIANCE AND A RESPECTIVE APPLIANCE

FIELD OF THE INVENTION

The invention concerns a method of reducing CO and $NO_x$ emissions in a heating appliance, and a respective appliance.

Particularly, the invention may be used in heating appliances which are not provided with a flue, for instance stoves and fireplaces fed with a gaseous fuel, which discharge the combustion products in the room where they are installed.

DESCRIPTION OF THE PRIOR ART

The above-mentioned heating appliances are commonly used to heat rooms which are not provided with a flue to convey the combustion products to the outside.

Since the combustion products are discharged in the room where the appliance is installed, there are very restrictive safety rules concerning the allowable content of toxic substances, such as carbon oxide CO and nitrogen oxides, in said combustion products.

The formation of CO in the combustion products depends on a plurality of factors:

- non-complete combustion of the fuel, which may be caused by an insufficient quantity of air in the air-fuel mixture supplied to the appliance;
- cooling of flame during combustion, which may be caused by a contact of the flame with cold surfaces having a temperature less than the temperature of the flame, or by a flow of cold air, the so-called secondary air, from the room onto the surface of the flame;
- excess of air in the air-fuel mixture supplied to the appliance, which causes a combustion with a too low temperature of the flame, resulting in a non-complete combustion of the fuel.

It is know that the formation of $NO_2$ does not take place directly at the inside of the flame during combustion, but subsequently in a region directly surrounding the flame where NO generated during combustion is oxidized.

Therefore, the formation of $NO_2$ depends both on the presence of NO in the combustion products and on the presence of oxidizers, such as $O_2$ and OH radicals, for instance $HO_2$ radicals, in said region directly surrounding the flame. The quantity of $HO_2$ radical depends on the temperature of the flame and decreases as the temperature increases.

The quantity of $NO_2$ in the combustion products may be reduced to very low values by using a bladed flame burner, such as the burner disclosed in EP-B-0373157 and EP-A-0537244, both in the name of the applicant. This burner makes possible to obtain very low contents of $NO_2$ in the combustion products. However, the use of the above mentioned burner does not allow to reduce CO emissions to very low values.

If a conventional burner with a "Bunsen" flame is used, it is possible to obtain a low content of CO in the combustion products, but the content of $NO_2$ continues to be high.

EP-A-0512801 discloses a combustion method for a radiant burner and a respective burner fed with a hyperstoichiometric mixture of gas fuels and air. Said method and burner allow the formation of CO and $NO_2$ in the combustion products to be eliminated or, at least, reduced to very low levels because the combustion of said mixture takes place on the surface of the diffuser of the burner, or close to said surface, thus limiting the contact of the combustion products with the ambient air, the so-called secondary air.

The above mentioned method, however, is not able to reduce the formation of CO to acceptable levels in bladed flame burners as described in the above mentioned EP-B-0373157 and EP-A-0537244 and the formation of $NO_2$ in "Bunsen" flame burners, because the flames of both said burners has a substantial height and the combustion does not take place on the surface of the burner or close to said surface.

In addition, the above method can not be used in a fireplace which is provided with a large front aperture through which the ambient air is free to enter the combustion chamber.

It is also known from EP-A-766046, which is considered the closest prior art, a flueless heating appliance comprising a combustion chamber having an opening in at least one side thereof to provide e view of at least a substantial portion of the combustion chamber, a flammable fluid fuel supply to said combustion chamber to provide, upon combustion, a substantial portion of yellow flame, an artificial log assembly provided in said combustion chamber and at least one reflective surface provided on at least one side of said primary combustion chamber to provide a reflected view of said substantially yellow flame and artificial log assembly. The heating appliance further comprises air circulating means to provide and/or direct a stream of air across at least a portion of said opening into said combustion chamber.

The primary object of the heating appliance disclosed in EP-A-766046 is to provide a realistic visual appearance of a wood fireplace. This object is obtained by generating flames having a substantially yellow appearance in the combustion chamber and by providing the combustion chamber with mirrors which provide a larger visual appearance of the fire. It is known that yellow flames produces combustion products containing a substantial amount of CO and NOx, which can not be exhausted in the environment where the appliance is placed. For this reason, the heating appliance disclosed in EP-A-766046 is provided with a catalytic converter forming a secondary combustion chamber in which the combustion products are further combusted to reduce the content of CO and NOx to acceptable levels. In addition, the air circulating means provided in the heating appliance serve to prevent or at least reduce spillage of the combustion products from the combustion chamber towards the environment in which the heating appliance is placed. The need for a catalytic converter and air circulating means makes the heating appliance disclosed in EP-A-766046 very costly and not completely reliable do to possible faults of the catalytic converter or air circulating means.

SUMMARY OF THE INVENTION

It is an object of the present invention to provide a method of reducing CO and $NO_2$ emissions in heating appliances without flue, provided with "Bunsen" flame burners or bladed flame burners, such as disclosed in EP-B-0373157 and EP-A-0537244. A further object of the present invention is to provide a heating appliance with low emissions of CO and $NO_2$. Such a method and heating appliance should be reliable and not very costly.

According to a first aspect of the present invention there is provided a method of combustion of a gaseous fuel in a heating appliance provided with at least one burner, said method comprising:

- mixing said gaseous fuel with a preestablished quantity of air to obtain an air-fuel mixture;

supplying said mixture to said at least one burner;

causing said mixture to pass through openings provided in a diffuser of said at least one burner;

generating flames causing the combustion of said mixture; and irradiating heat towards said flames and a region directly surrounding said flames.

According to a second aspect of the present invention there is provided a method of combustion of a gaseous fuel in a heating appliance provided with at least one burner, said method comprising:

mixing said gaseous fuel with a preestablished quantity of air to obtain an air-fuel mixture, supplying said mixture to said at least one burner;

causing said mixture to pass through openings provided in a diffuser of said at least one burner;

generating flames causing the combustion of said mixture; and limiting the inflow of air from the outside of said appliance into a region directly surrounding said flames, said limiting being obtained through gaseous barrier means, wherein said gaseous barrier means is obtained through natural circulation of gaseous means.

According to a third aspect of the present invention there is provided a heating appliance comprising at least one burner fed with a mixture of gaseous fuel and air, said at least one burner being provided with a diffuser having openings through which said mixture passes and with means to cause the combustion of said mixture and the formation of at least one flame, wherein said heating appliance further comprises heat irradiating means for irradiating heat towards said at least one flame and a region directly surrounding said flame.

According to a fourth aspect of the present invention there is provided a heating appliance comprising at least one burner fed with a mixture of gaseous fuel and air, said at least one burner being provided with a diffuser having openings through which said mixture passes and with means to cause the combustion of said mixture and the formation of flames, said heating appliance comprising barrier means capable of limiting the inflow of air from the outside into said heating appliance in a region directly surrounding said flames, said barrier means comprising gaseous barrier means, wherein said gaseous barrier means is obtained through natural circulation of gaseous means.

Irradiating heat on the flame and in the region directly surrounding the flame makes it possible to keep in said region a temperature high enough to substantially reduce the formation, and the presence, of CO and NO2 in the combustion products.

In addition, the provision of gaseous barrier means to limit the inflow of air from the outside into the heating appliance minimizes losses of heat from the combustion chamber, preventing the temperature in the region of the flames from decreasing below the value required for minimizing the formation of CO and NOx.

BRIEF DESCRIPTION OF THE DRAWINGS

Further features and advantages of the present invention will be explained in the following description and in the enclosed drawings in which:

With reference to FIG. 1, reference numeral 1 denotes a heating appliance featured as a stove, provided with an outer casing 2 inside which a combustion chamber 3 is defined, said combustion chamber being bounded by said outer casing 2.

Figure 2:
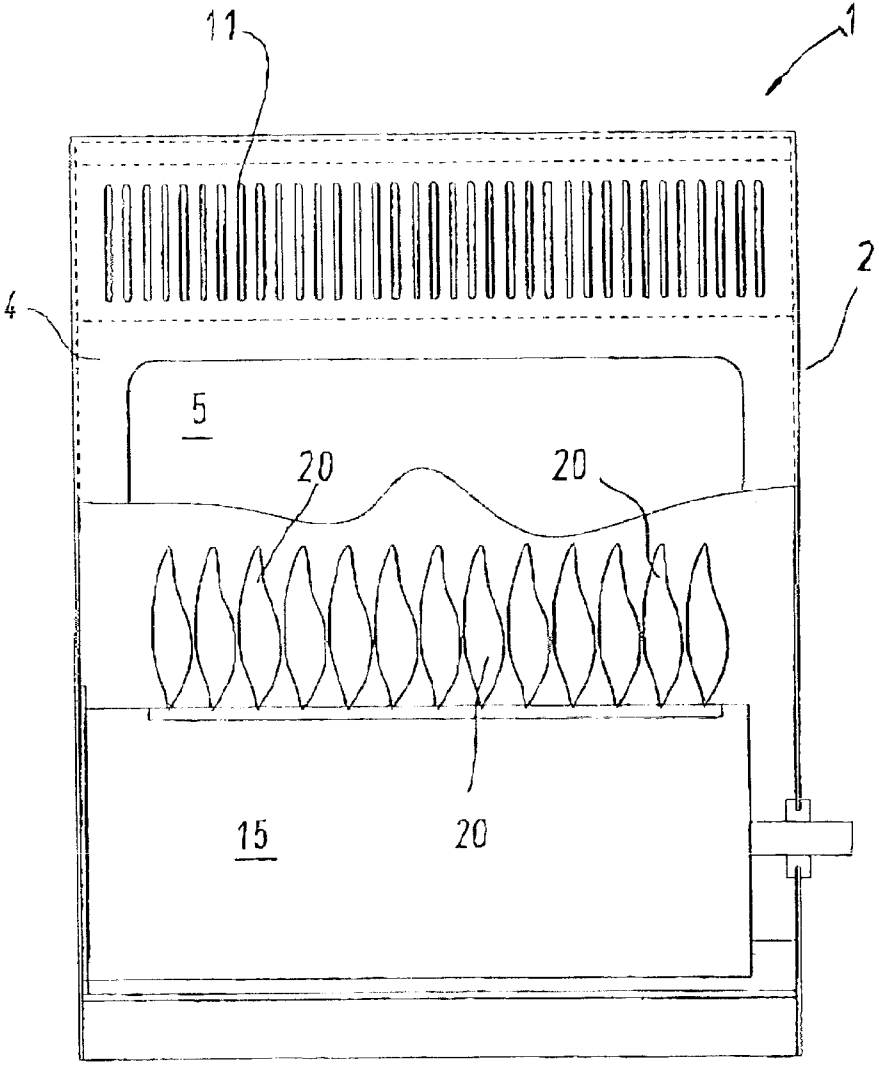
FIG. 2 is a partly sectioned front view of the heating appliance of FIG. 1.
Figure 1:
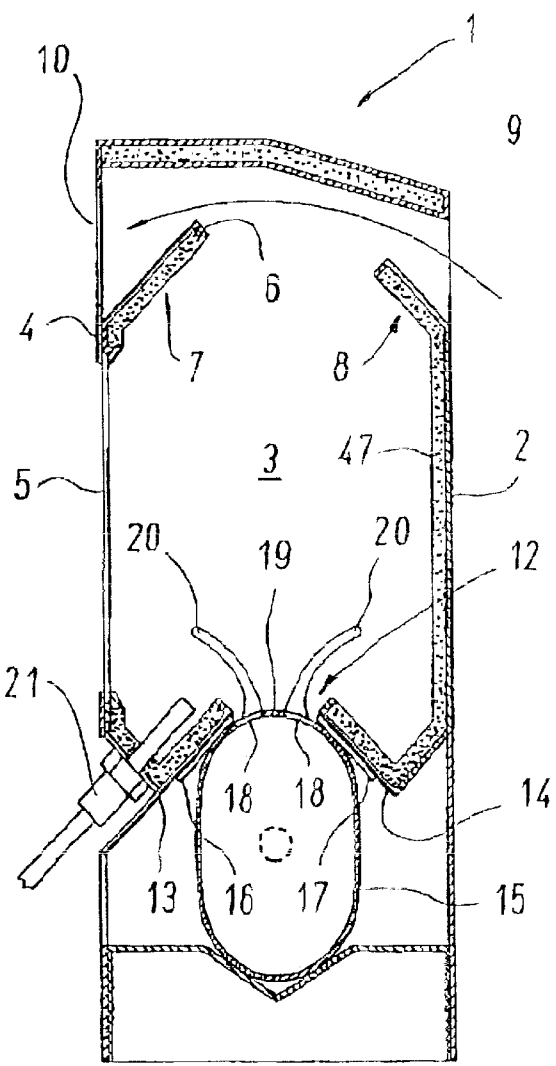
FIG. 1 is a cross section of a heating appliance featured as a stove without flue.

A front portion 4 of said casing 2 is movable in order to permit access to said combustion chamber 3, said portion 4 being provided with a glass 5, so that said combustion chamber 3 is visible from the outside.

In the upper portion of the combustion chamber 3 an upper opening 6 is defined by two wall portions 7 and 8 converging upward, said upper opening communicating with a conduit 8*a* discharging outside the combustion products. A first end of the conduit 8*a* facing toward the back side of the appliance 1 is provided with a first opening 9 allowing air to enter into the conduit from the outside and a second end of the conduit 8*a* facing toward the front side of the appliance 1 is provided with a second opening 10 leading, for instance, to a position above said front section 4 of the casing 2, said second opening 10 being provided with a grid 11. The air entering said first opening 9 from the outside is mixed to the combustion products coming from the combustion chamber 3 in order to cool them, so that emission of too hot fumes through the grid 11 is prevented.

The combustion chamber 3 is further provided with a lower opening 12 defined by two lower wall portions 13 and 14 converging upward. A burner 15, for instance a burner as disclosed in EP-B-0373157 and EP-A-0537244, is arranged below said lower wall portions 13 and 14, so that the body of the burner 15 is forced against said wall portions. Two seal means 16 and 17 are interposed between the burner 15 and said wall portions 13 and 14, so that the inflow of air from the outside through said lower opening 12 into the combustion chamber 3 is prevented.

The mixture of fuel gas and air supplied to the burner 15 passes through openings 18 made in the burner diffuser 19 and penetrates, via said lower opening 12, into said combustion chamber 3, in which the combustion of said mixture takes place, generating a plurality of flames 20, for instance bladed flames, as disclosed in EP-B-0373157 and EP-A-0537244, above said openings 18. The appliance 1 is further provided with a pilot burner 21, designed to ignite the combustion of the mixture supplied to the burner 15.

The walls of the casing 2 defining the combustion chamber 3, with the exception of the front wall 4 provided with glass 5, are provided with a lining 47 made of a material capable of accumulate and irradiate heat, for instance a ceramic material, said lining extending over the whole surface of said walls or only over a portion thereof. Said lining may be also extended to the upper wall portions 7 and 8 and to the lower wall portions 13 and 14.

During operation of the appliance 1, said lining 47 accumulates heat and irradiates it into the combustion chamber 3, particularly toward the flames 20 and the region directly surrounding the flames, thus allowing the temperature of said region to be maintained so high as to prevent, or at least reduce to very low levels, the formation of CO and $NO_2$ in the combustion products.

Particularly, when a burner 15, as disclosed in EP-B-0373157 and EP-A-0537244, is used, that is a burner with a very low formation of $NO_2$, the accumulation of heat in the lining 47 and its subsequent irradiation allows the formation of $NO_2$ to be prevented, or reduced to very low levels.

It is to be noticed, that, when the lining 47 is limited only to some regions of the inner surface of the walls of the combustion chamber, said regions are chosen in such a way as to allow heat accumulated in the lining 47 to be irradiated mainly toward the flames 20 and the region directly surrounding the flames.

Figure 3:
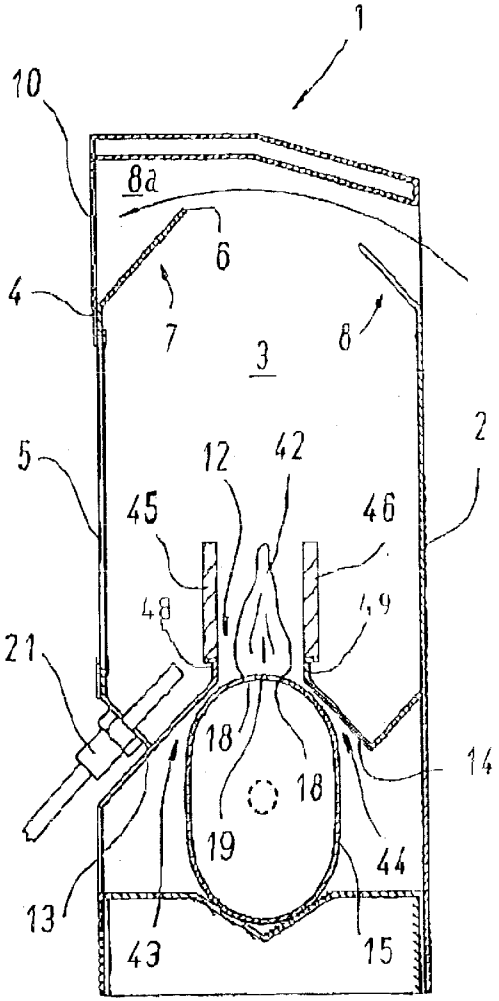
FIG. 3 is a section as in FIG. 1, illustrating a variation of the heating appliance of FIG. 1.

In FIG. 3 a variation of the appliance is illustrated, wherein the lower wall portions 13 and 14 are not in contact with the burner 15, thus defining two passages 43 and 44 through which air from the outside, the so-called secondary air, enters the combustion chamber 3.

Heat irradiating means 45 and 46 are arranged on respective supports 48 and 49 above the diffuser 19 of the burner 15, said heat irradiating means 45 and 46 extending substantially through the whole length of that portion of diffuser provided with the apertures 18. Said irradiating means, when the appliance 1 operates, irradiate heat toward the flames 42 and in the region directly surrounding the flames.

Said heat irradiating means 45 and 46 may comprise heat accumulating means made of a material capable of accumulating heat and irradiate it, for instance a ceramic material. Alternatively, said irradiation means may comprise heat reflecting means, such as, for instance, parabolic mirrors. In addition, said irradiating means 45 and 46 may comprise heat generating means, for instance electric resistance heat generating means.

The use of said irradiating means 45 and 46 is particularly advisable when burners with "Bunsen" flames are used, which need secondary air for a proper operation, and when the burner 15 is fed with liquid gas fuel, because the formation of $NO_2$ in the combustion products is more likely when said kind of fuel is used.

Figure 4:
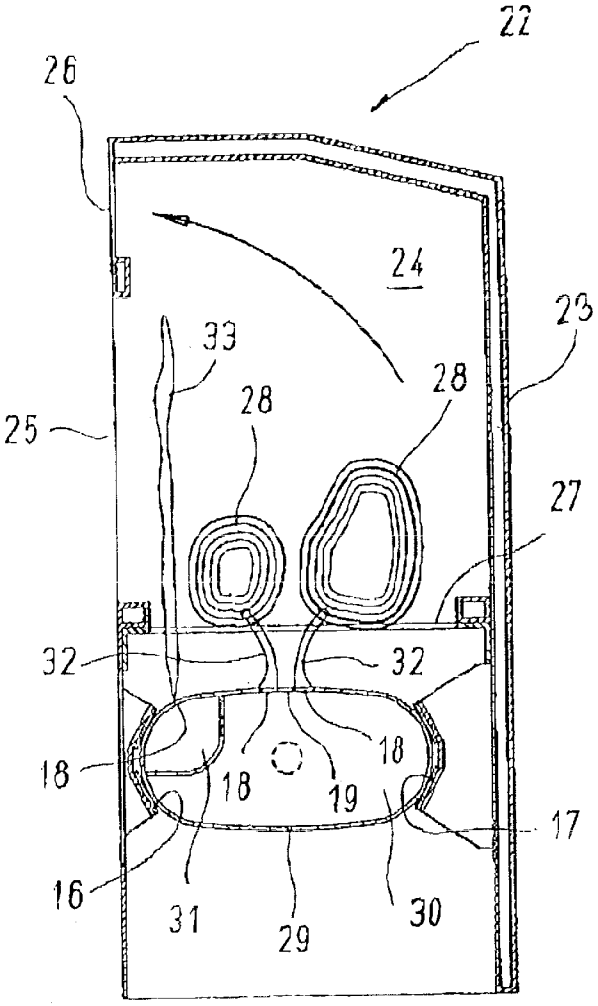
FIG. 4 is a transverse section of a heating appliance featured as a fireplace without flue.
Figure 6:
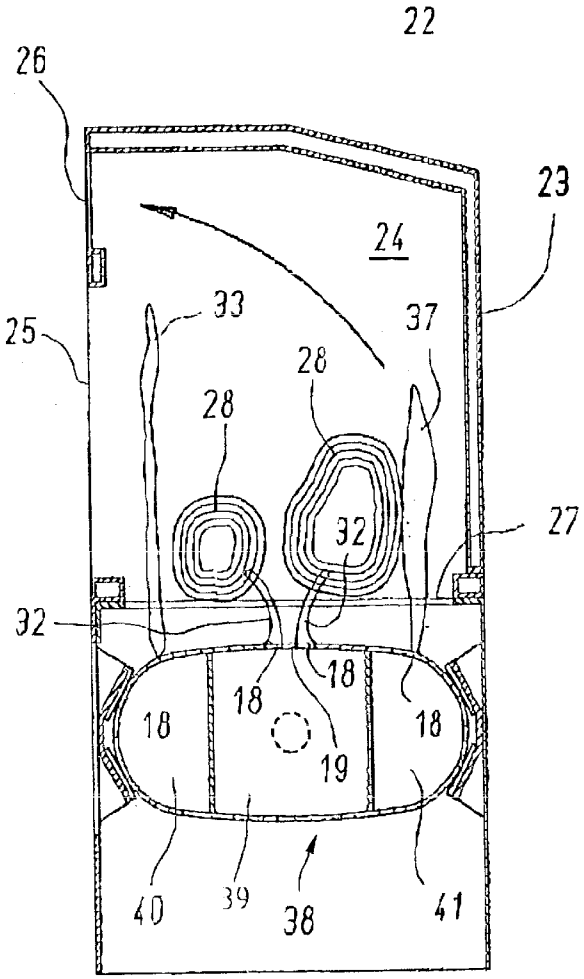
FIGS. 5 and 6 are transverse sections as in FIG. 3, illustrating variations of the heating appliance of FIG. 4.
Figure 5:
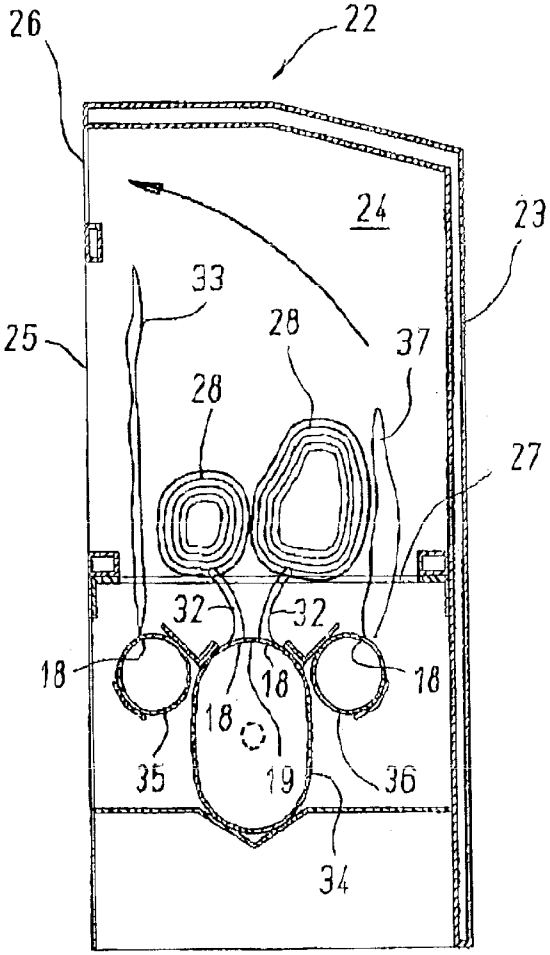

FIGS. 4, 5 and 6 illustrate heating appliances 22 without flue according to the invention, featured as fireplaces.

Said appliances comprise a casing 23 inside which a combustion chamber 24 is defined, the combustion chamber 24 being provided with a front opening 25 communicating with the outside and with an upper opening 26 through which the combustion products are discharged. Inside the combustion chamber 24 one or more elements 28, made of a material resistant to high temperatures, for instance made of ceramic material and simulating bits of wood, are arranged on respective supports 27 provided with apertures, for instance grid supports.

In a first embodiment of the appliance 22, shown in FIG. 4, a burner 29 is arranged below the support 27, said burner having a body divided into two sections 30 and 31 fed independently. A first section 30 is capable of generating first violet colored flames 32, for instance bladed flames as disclosed in EP-B-0373157 and EP-A-0537244, which get in touch with said elements 28 increasing their temperature up to red heat, in order to simulate embers of a conventional fireplace.

The second section 31 of the burner 29 is capable of generating second yellow "Bunsen" flames, which simulate the flames generated by the combustion of a piece of firewood in a conventional fireplace.

The second section 31 of the burner 29 is arranged in such a way as to allow the second flames 33 to be arranged between the first flames 32 and the front opening 25 of the appliance 22. Owing to this arrangement, the second flames 33 and/or a natural circulation of the column of hot combusted gases produced by said flames constitute a barrier preventing air from entering the combustion chamber 24 from the outside. Said barrier allows a so high temperature to be maintained in the combustion chamber and, particularly, in the region directly surrounding the flames 32 and 33, as to reduce the formation of CO and $NO_2$ in the combustion products of the first flames 32.

The reduction of formation of CO and $NO_2$ in the combustion products may be optimized if the first section 30 of the burner 29 is made like a bladed flame burner, as disclosed in EP-B-0373157 and EP-A-0537244. A further reduction of the formation of $NO_2$ may be obtained if the thermal power produced by said first section 30 is not less than the thermal power produced by said second section, preferably substantially higher. For instance, the thermal power produced by said second section may be between 20% to 30% of the total thermal power of the burner 29.

FIG. 5 shows a second embodiment of the appliance 22, wherein three burners are arranged below the support 27: a first central burner 34, for instance a burner like that disclosed in EP-B-0373157 and EP-A-0537244, capable of generating first violet flames 32, a second front burner 35, capable of generating second yellow "Bunsen" flames 33 and a third rear burner 36 capable of generating third yellow "Bunsen" flames 37, which simulate the flames generated by the combustion of pieces of firewood in a conventional fireplace. Said third burner 36 is arranged in such a way as to allow said third flames 37 to be arranged more remote from said front opening 25 than said second flames 32 and to be seen, for instance, behind said elements 28, when one looks at the combustion chamber through the front opening 25, said arrangement improving the visual simulation of the combustion of pieces of firewood in a conventional fireplace.

Even in said second embodiment of the appliance 22, the second flames 33 generated by the second burner 35 and/or a natural circulation of the respective column of hot combusted gases constitute a barrier against the penetration of air into the combustion chamber 24 from the outside.

Even in said second embodiment, in order to optimize the reduction of the formation of $NO_2$ in the combustion products, it is advisable that the thermal power generated by the first burner 34 is not less, or preferably substantially higher, than the thermal power generated by the second burner 35 and third burner 36 together.

FIG. 6 shows a third embodiment of the appliance 22 according to the invention, which is provided with a single burner 38 having a body divided into three sections fed separately: a first central section 39 capable of generating said first flames 32, for instance bladed flames such as disclosed in EP-B-0373157 and EP-A-0537244, a second front section 40 capable of generating said second flames 33 and a third rear section 41 capable of generating said third flames 37.

Even in said third embodiment of the appliance 22, it is advisable that the thermal power generated by said first central section 39 is not less, preferably substantially higher, than the thermal power generated by said second front section 40 and said third section 41 together.

All the embodiments of the appliance 22 shown in FIGS. 4, 5 and 6 may have the walls of the combustion chamber 24 provided with a lining 47 made of a material capable of accumulating heat.

The exemplary embodiments of the invention shown concern heating appliances without flue, but the invention may be equally used in heating appliances provided with flue.

What is claimed is:

1. A method of combustion of a gaseous fuel in a heating appliance provided with at least one burner, said method comprising: mixing said gaseous fuel with a preestablished quantity of air to obtain an air-fuel mixture, supplying said mixture to said at least one burner, causing said mixture to pass through openings provided in a diffuser of said at least one burner, generating flames causing the combustion of said mixture, irradiating heat towards said flames in a region directly surrounding said flames, limiting an inflow of air from the outside of said appliance into said region directly surrounding said flames, wherein said limiting is obtained through gaseous barrier means.

2. A method according to claim 1, wherein said irradiating is obtained through heat accumulating means.

3. A method according to claim 1, wherein said irradiating is obtained through heat reflecting means.

4. A method according to claim 1, wherein said irradiating is obtained through heat generating means.

5. A method of combustion of a gaseous fuel in a heating appliance provided with at least one burner, said method comprising: mixing said gaseous fuel with a preestablished quantity of air to obtain an air-fuel mixture, supplying said mixture to said at least one burner, causing said mixture to pass through openings provided in a diffuser of said at least one burner, generating flames causing the combustion of said mixture, and limiting an inflow of air from the outside of said appliance into a region directly surrounding said flames, said limiting being obtained through gaseous barrier means, wherein said gaseous barrier means is obtained through natural circulation of gaseous means.

6. A method according to claim 1, or 5, wherein said gaseous barrier means comprises flames generated by the combustion of said mixture.

7. A method according to claim 6, wherein said gaseous barrier means (33) are arranged between an opening (25) of a combustion chamber (24) of said appliance (1; 22) communicating with the outside and the combustion chamber (24).

8. A method according to claim 1, or 5, wherein said gaseous barrier means comprises combusted gas generated by said flames.

9. A heating appliance comprising at least one burner fed with a mixture of gaseous fuel and air, said at least one burner being provided with a diffuser having openings through which said mixture passes and with combustion means to cause the combustion of said mixture and the formation of flames, said heating appliance comprising heat irradiating means which are so shaped and arranged as to irradiate heat towards said flames and a region directly surrounding said flames, said at least one burner generating bladed flames, said heating appliance further comprising barrier means for limiting an inflow of air from the outside into said heating appliance in a region directly surrounding said flames, wherein said barrier means comprises upward converging lower wall portions of a combustion chamber defined at the inside of a casing of the heating appliance, said at least one burner being arranged below said lower wall portions, sealing means being arranged between said lower wall portions and said at least one burner, said lower wall portions defining at least one passage for said mixture of gas fuel and air.

10. A heating appliance according to claim 8, wherein said at least one burner (15) is arranged so as to exert a pressure against said sealing means (16, 17).

11. A heating appliance comprising at least one burner fed with a mixture of gaseous fuel and air, said at least one burner being provided with a diffuser having openings through which said mixture passes and with combustion means to cause the combustion of said mixture and the formation of flames, said heating appliance comprising heat irradiating means which are so shaped and arranged as to irradiate heat towards said flames and a region directly surrounding said flames, said at least one burner generating bladed flames, said heating appliance further comprising barrier means for limiting an inflow of air from the outside into said heating appliance in a region directly surrounding said flames, wherein said barrier means comprises gaseous barrier means.

12. A heating appliance comprising at least one burner fed with a mixture of gaseous fuel and air, said at least one burner being provided with a diffuser having openings through which said mixture passes and with combustion means to cause the combustion of said mixture and the formation of flames, said heating appliance further comprising barrier means for limiting an inflow of air from the outside into said heating appliance in a region directly surrounding said flames, said barrier means comprising gaseous barrier means, wherein said gaseous barrier means is obtained through natural circulation of gaseous means.

13. A heating appliance according to claim 11, or 12, wherein said gaseous barrier means comprises flames generated by the combustion of said mixture.

14. A heating appliance according to one of claims 11, or 12, wherein said gaseous barrier means (33) are arranged between an opening (25) of a combustion chamber defined at the inside of a casing (23) of the heating appliance (22) and the combustion chamber itself, said opening (25) communicating with the outside of the heating appliance (22).

15. A heating appliance according to claim 11, or 12, wherein said at least one burner comprises a body divided into two sections fed independently: a first section which generates first flames and a second section which generates second flames, said second flames and combusted gas generated by said second flames constituting said gaseous barrier means.

16. A heating appliance according to claim 15, wherein said first section generates bladed flames.

17. A heating appliance according to claim 15, wherein said second section is arranged in such a way as to allow the second flames to be arranged between said first flames and said opening.

18. A heating appliance according to one of claim 15, wherein said first section (30) generates a thermal power at least equal to the thermal power generated by said second section (31).

19. A heating appliance according to claim 18, wherein said first burner generates bladed flames.

20. A heating appliance according to claim 18, wherein said second burner is arranged in such a way as to allow said second flames to be arranged between said first flames and said opening.

21. A heating appliance according to claim 18, further comprising a third burner (36) generating third flames (37).

22. A heating appliance according to claim 21, wherein said third burner is arranged in such a way as to allow said third flames to be arranged more remote from said opening than said second flames.

23. A heating appliance according to claim 21, or 22, wherein said first burner (32) generates a thermal power at least equal to the thermal power generated by said second burner (35) and said third burner (36) together.

24. A heating appliance according to claim 11, or 12, wherein said at least one burner comprises a first burner generating first flames and a second burner generating second flames, said second flames and combusted gases generated by said second flames constituting said gaseous barrier means.

25. A heating appliance according to claim 11, or 12, wherein said at least one burner comprises a body divided into three sections fed independently: a central section which generates first flames, a front section which generates second flames and a rear section which generates third flames, said second flames and combusted gases generated by said second flames constituting said gaseous barrier means.

26. A heating appliance according to claim 25, wherein said central section generates bladed flames.

27. A heating appliance according to claim 25, wherein said front section is arranged in such a way as to allow said second flames to be arranged between said first flames and said opening.

28. A heating appliance according to claim 25, wherein said central section generates a thermal power at least equal to the thermal power generated by said front section and said rear section together.

29. A heating appliance according to claim 11, or 12, wherein said gaseous barrier means comprises combusted gas generated by said flames.

30. A heating appliance according to claim 9, or 11, wherein said irradiating means comprises heat accumulating means.

31. A heating appliance according to claim 30, wherein said heat accumulating means comprises ceramic material.

32. A heating appliance according to claim 30, wherein said heat accumulating means comprises a lining of an inner surface of walls a combustion chamber defined at the inside of a casing of said heating appliance.

33. A heating appliance according to claim 32, wherein said lining extends to the whole inner surface of said walls.

34. A heating appliance according to claim 32, wherein said lining is limited to preestablished portions of said inner surface.

35. A heating appliance according to claim 9, or 11, wherein said heat irradiating means comprises heat reflecting means.

36. A heating appliance according to claim 9, or 11, wherein said heat irradiating means comprises heat generating means.

37. A heating appliance according to claim 36, wherein said heat generating means comprises electric resistance heat generating means.

38. A heating appliance according to claim 9, or 11, wherein said heat irradiating means are arranged close to the surface of said diffuser substantially through that portion of diffuser provided with said openings.

39. A method of combustion of a gaseous fuel in a heating appliance provided with at least one burner, said method comprising: mixing said gaseous fuel with a preestablished quantity of air to obtain an air-fuel mixture, supplying said mixture to said at least one burner, causing said mixture to pass through openings provided in a diffuser of said at least one burner, generating flames causing the combustion of said mixture, wherein for reducing CO and NO2 emissions it further comprises limiting an inflow of air from the outside of said appliance into a region directly surrounding said flames, said limiting being obtained by physical barrier means arranged in the vicinity of said region.

40. A method according to claim 39 and further comprising providing heat irradiating means for irradiating heat towards said flames and said region surrounding said flames.

41. A method according to claim 40, wherein said irradiating is obtained through heat accumulating means.

42. A method according to claim 40, wherein said irradiating is obtained through heat reflecting means.

43. A method according to claim 40, wherein said irradiating is obtained through heat generating means.

44. A heating appliance comprising at least one burner fed with a mixture of gaseous fuel and air, said at least one burner being provided with a diffuser having openings through which said mixture passes and with combustion means to cause the combustion of said mixture and the formation of flames, wherein said heating appliance for reducing CO and NO2 emissions comprises physical barrier means so shaped and arranged as to limit the inflow of air from the outside of said appliance into a region surrounding said flames.

45. A heating appliance according to claim 44 and further comprising heat irradiating means for irradiating heat towards said flames and said region surrounding said flames.

46. A heating appliance according to claim 45, wherein said physical barrier means comprises said heat irradiating means.

47. A heating appliance according to 46, wherein said heat irradiating means are arranged close to the surface of said diffuser substantially through that portion of diffuser provided with said openings.

48. A heating appliance according to one of claims 45 to 47, wherein said heat irradiating means comprises heat accumulating means.

49. A heating appliance according to one of claims 48, wherein said heat irradiating means comprises ceramic material.

50. A heating appliance according to claim 48, wherein said heat accumulating means comprises a lining of an inner surface of walls of a combustion chamber defined at the inside of a casing of said heating appliance.

51. A heating appliance according to claim 50, wherein said lining extends to the whole inner surface of said walls.

52. A heating appliance according to claim 50, wherein said lining is limited to preestablished portions of said inner surface.

53. A heating appliance according to claim 45, wherein said heat irradiating means comprises heat reflecting means.

54. A heating appliance according to claim 45, wherein said heat irradiating means comprises heat generating means.

* * * * *

UNITED STATES PATENT AND TRADEMARK OFFICE

CERTIFICATE OF CORRECTION

PATENT NO. : 6,578,570 B2 
DATED : June 17, 2003
INVENTOR(S) : Giuseppe Fogliani and Gunther Berthold It is certified that error appears in the above-identified patent and that said Letters Patent is hereby corrected as shown below:

Column 1,
Line 40, after "It is" delete "know" and insert therein -- known --
Line 48, before "on the" delete "radical depends" and insert therein -- radicals depend --

Column 2,
Line 19, after "provide" delete “e” and insert therein -- a --

Column 7,
Lines 32-36, delete entire claim and insert -- A method according to claim 6, wherein said gaseous barrier means are arranged between an opening of a combustion chamber of said appliance communicating with the outside and the combustion chamber. --
Lines 60-62, delete entire claim and insert -- A heating appliance according to claim 8, wherein said at least one burner is arranged so as to exert a pressure against said sealing means. --

Column 8,
Lines 23-28, delete entire claim and insert -- A heating appliance according to claim 11, or 12, wherein said gaseous barrier means are arranged between an opeining of a combustion chamber defined at the inside of a casing of the heating appliance and the combustion chamber itself, said opening communicating with the outside of the heating appliance. --
Lines 42-45, delete entire claim and insert -- A heating appliance according to claim 15, wherein said first section generates a thermal power at least equal to the thermal power generated by said second section. --
Lines 52-53, delete entire claim and insert --A heating appliance according to claim 18, further comprising a third burner generating third flames. --
Lines 58-61, delete entire claim and insert -- A heating appliance according to claim 21, or 22, wherein said first burner generates a thermal power at least equal to the thermal power generated by said second burner and said third burner together. --

UNITED STATES PATENT AND TRADEMARK OFFICE

CERTIFICATE OF CORRECTION

PATENT NO. : 6,578,570 B2 
DATED : June 17, 2003
INVENTOR(S) : Giuseppe Fogliani and Gunther Berthold It is certified that error appears in the above-identified patent and that said Letters Patent is hereby corrected as shown below:

Column 9,
Line 56, after "CO and" delete "NO2" and insert therein -- $NO_2$ --

Column 10,
Line 21, after "CO and" delete "NO2" and insert therein -- $NO_2$ --
Line 31, after "according to" insert therein -- claim --
Line 38, after "according to" delete "one of claims" and insert therein -- claim --

Signed and Sealed this

Twenty-first Day of October, 2003

JAMES E. ROGAN
*Director of the United States Patent and Trademark Office*